United States Patent [19]

Kolt

[11] Patent Number: 4,567,816

[45] Date of Patent: Feb. 4, 1986

[54] UNIDIRECTIONAL VENT

[75] Inventor: Stanley Kolt, Mamaroneck, N.Y.

[73] Assignee: Leonard W. Suroff, Jericho, N.Y. ; a part interest

[21] Appl. No.: 673,586

[22] Filed: Nov. 21, 1984

[51] Int. Cl.[4] ..... F16K 24/04

[52] U.S. Cl. ..... 98/42.16; 137/512.15

[58] Field of Search ..... 98/42 R, 43 R, 43 C, 98/41 R, 116, 119; 126/288, 295; 137/512.15; 251/111, 113, 297, 298, 299, 251, 303

[56] References Cited

U.S. PATENT DOCUMENTS

| | | | |
|---|---|---|---|
| 891,967 | 6/1908 | Wiemann | 98/119 |
| 928,481 | 7/1909 | Tehold et al. | 251/298 X |
| 2,272,960 | 2/1942 | Young, Jr. | 251/297 X |
| 2,846,935 | 8/1958 | Still | 98/119 X |
| 3,120,167 | 2/1964 | Kearny | 98/116 X |
| 3,382,895 | 5/1968 | McCullough | 251/248 X |
| 4,108,238 | 8/1978 | Vary et al. | 98/119 X |

FOREIGN PATENT DOCUMENTS

| | | | |
|---|---|---|---|
| 2652838 | 5/1978 | Fed. Rep. of Germany | 98/42 R |
| 522966 | 4/1955 | Italy | 98/116 |

*Primary Examiner*—Harold Joyce

*Attorney, Agent, or Firm*—Leonard W. Suroff

[57] ABSTRACT

An energy saving unidirectional vent, for permitting the passage of air from one defined space to another includes a frame for mounting over an opening communicating therebetween. The frame having a central passageway disposed therethrough and a flap movably mounted to the frame, so as to be movable from a closed position substantially blocking the passageway, to an open position, permitting the flow of air therethrough. A membrane is affixed to the flap on the surface facing the exhaust defined space. An adjustment device is provided to maintain the flap in a partially open position, if desired.

14 Claims, 5 Drawing Figures

UNIDIRECTIONAL VENT

BACKGROUND OF THE INVENTION

1. Field of the Invention

The present invention relates generally to vents for use in permitting the passage of air from one defined space to another such as through the ceiling of a room into an attic space, and more particularly is directed to a vent that is unidirectional when closed and is capable of equalizing air pressure when sudden drops in outside pressure occur.

2. Description of the Relevant Art

It is frequently desirable to permit the venting of air from a room space into an attic which is in itself vented to the outside atmosphere. As a result of such an arrangement, when the attic is vented through active or passive means, the rooms which employ such automatic vents can also be similarly vented. For example, cool air can be permitted to enter the rooms and simultaneously, warmer air with contaminants, odoriferous aromas and moisture can be caused to rise to the ceilings of the rooms and through automatic vents mounted on the ceilings into the attic space so that they can be vented from the attic space and then out of the building. Ventilators which are employed to vent from attic areas, or the like, through roofs to the atmosphere are known in the art. Such devices include those shown in U.S. Pat. Nos. 4,123,001 and 4,210,277 invented by the inventor of the subject invention. Additionally, an automatic ceiling ventilator is disclosed in U.S. patent application, Ser. No. 505,789 filed June 20, 1983, also by the same inventor as the present invention.

Other ventilators are also shown in U.S. Pat. Nos. 1,737,054; 3,921,900; and 3,976,245.

Unfortunately, for various reasons, including their large size and complexity, none of the presently known vents are capable of permitting air to flow outwardly (exhaust or vent into an attic) when closed and warm and/or odoriferous rising air currents are present. Furthermore these vents generally are unable to quickly equalize the air pressure within a room (defined space) when a sudden external (atmospheric) pressure drop occurs.

A simplified and compact construction of the ceiling vent is also desirable since this almost necessarily dictates a reduction in cost.

An additional disadvantage of known devices is that they are maintained in an entirely closed position until the temperature of the temperature responsive mechanisms is reached. In certain instances the entire blockage of air flow is not desirable and it may be desirable to permit minimal air flow regardless of the temperature of the air proximate the venting device. An apparatus for providing air flow with minimal rising air currents has not been disclosed in the relevant art.

The present invention overcomes the shortcomings associated with the relevant art by providing an automatic unidirectional vent for permitting the passage of air from one defined space to another which includes a device for permitting the desired air flow even when the vent is in a closed position. In addition, the present invention includes an apparatus for equalizing air pressure if the outside (atmospheric) pressure suddenly drops. Moreover, the instant invention can be installed in a ceiling opening from the room side of such opening with minimal effort and expense.

OBJECTS OF THE INVENTION

An object of the present invention is to provide a unidirectional vent for use in ventilating systems wherein rooms are to be vented into attics or other similarly defined spaces.

Another object of the present invention is to provide a vent which requires no maintenance and which achieves its venting function without human intervention.

A further object of the present invention is to provide a vent which is activated automatically in response to a sudden drop in outside (atmospheric) pressure.

A yet further object of the present invention is to provide an automatic vent which can provide venting with a minimal air flow with the vent in a closed position.

Still another further object of the present invention is to provide a vent which employs essentially no moving parts, thereby minimizing the cost of maintenance and manufacture.

An additional object of the present invention is to provide a vent which is capable of reducing the back-flow of cold air.

A still additional object of the present invention is to provide a vent which can be used in conjunction with attic-type ventilators to provide an integrated house ventilation system.

SUMMARY OF THE INVENTION

An energy saving unidirectional vent for permitting the passage of air from one defined space to another is disclosed for installation in the ceiling of rooms of a house wherein the rooms are vented into an attic area which is itself vented to the outside atmosphere. The damper or flap of the vent is automatically opened by a drop in atmospheric pressure or rising air currents. In addition, an adjustment device is provided to open the flap a desired amount so that continuous ventilation can take place when the membrane affixed to the vent flap is not activated to cause opening thereof.

A vent, according to the principles of the instant invention, includes; a frame which is configured for mounting over an opening communicating between one defined space to another defined space, such as an opening provided in the ceiling of a room, the frames having a central passageway disposed therethrough. A flap is movably mounted to the frame, preferably by a suitable pivot arrangement, such that the flap is movable from a closed position, substantially blocking the passageway in the frame, to an open position permitting the free flow of air therethrough, the flap assuming the closed position when at rest due to the effect of gravity. A membrane is affixed to the flap on the upper surface thereof to cover the openings provided in the flap to prevent the back-flow of cold air when the flap is in a closed position. An adjustment device in the form of a movable knob which acts upon a wedge provided on the flap is provided to set the flap to a predetermined open position, if desired when at rest, thereby providing some degree of ventilation.

The foregoing and other objects and advantages will appear from the description to follow. In the description reference is made to the accompanying drawing which forms a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the spirit and scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
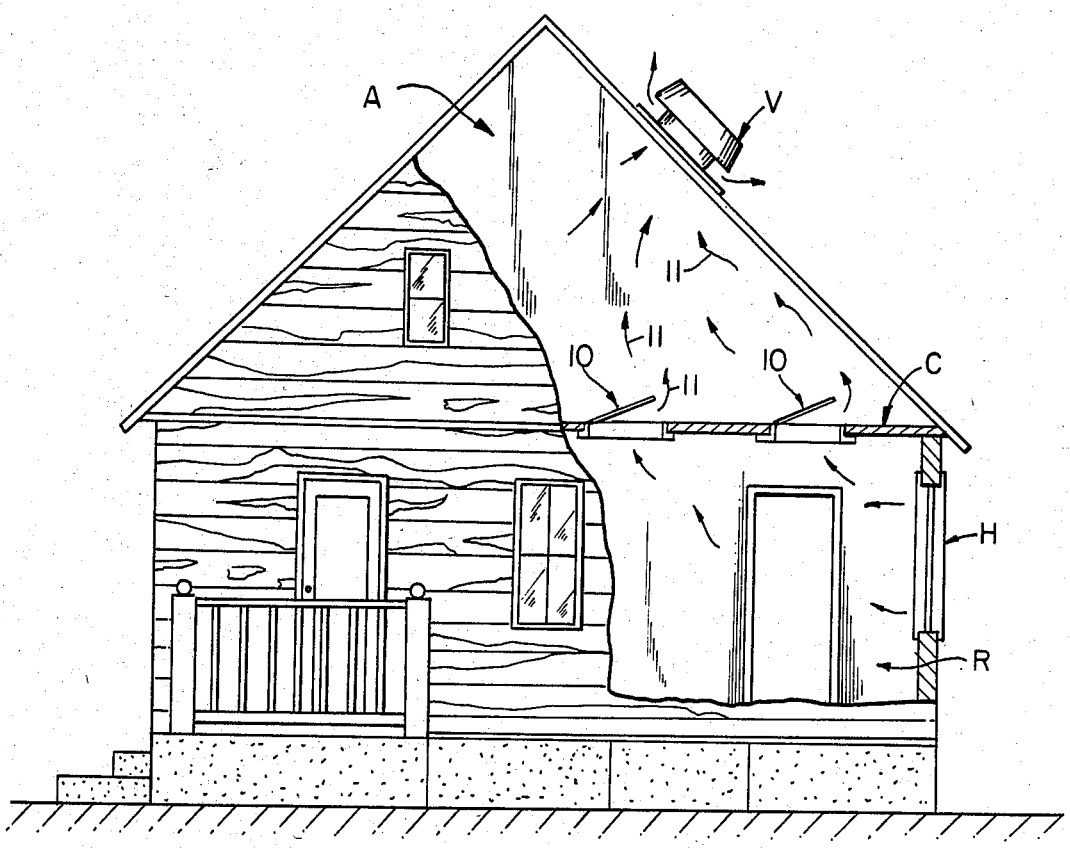
FIG. 1 is a partially broken-away side elevational view of a house in which a plurality of unidirectional vents and an attic vent are installed.

Referring now to the figures and more particularly, to FIG. 1, there is illustrated a house H having an attic A and a room R adjacent to the attic A. An automatic roof ventilator V is installed in the roof of the house H and vents the attic A to the outside atmosphere. A pair of vents 10 are installed in the ceiling C of the house H above the room R and serve to vent the room R into the attic A. The construction of the vents 10 will be hereinafter described in conjunction with FIGS. 2 through 5.

The vents 10 are each constructed so that they open and permit the flow, as is illustrated by the arrows 11 in FIG. 1, of fresh air to enter the room R and stale air to be exhausted into the attic A where it is then vented to the outside atmosphere through the vent V. Depending on the mechanical adjustment see (FIG. 5) of the unidirectional vents 10, they can be entirely closed or can be opened a desired degree to permit ventilation. In a typical installation, one automatic temperature responsive vent 10 is placed in the ceiling of each room adjacent to the attic so that each room has an equal opportunity to have the contaminated and/or undesirable air vent therefrom through the attic to the outside atmosphere.

Figure 2:
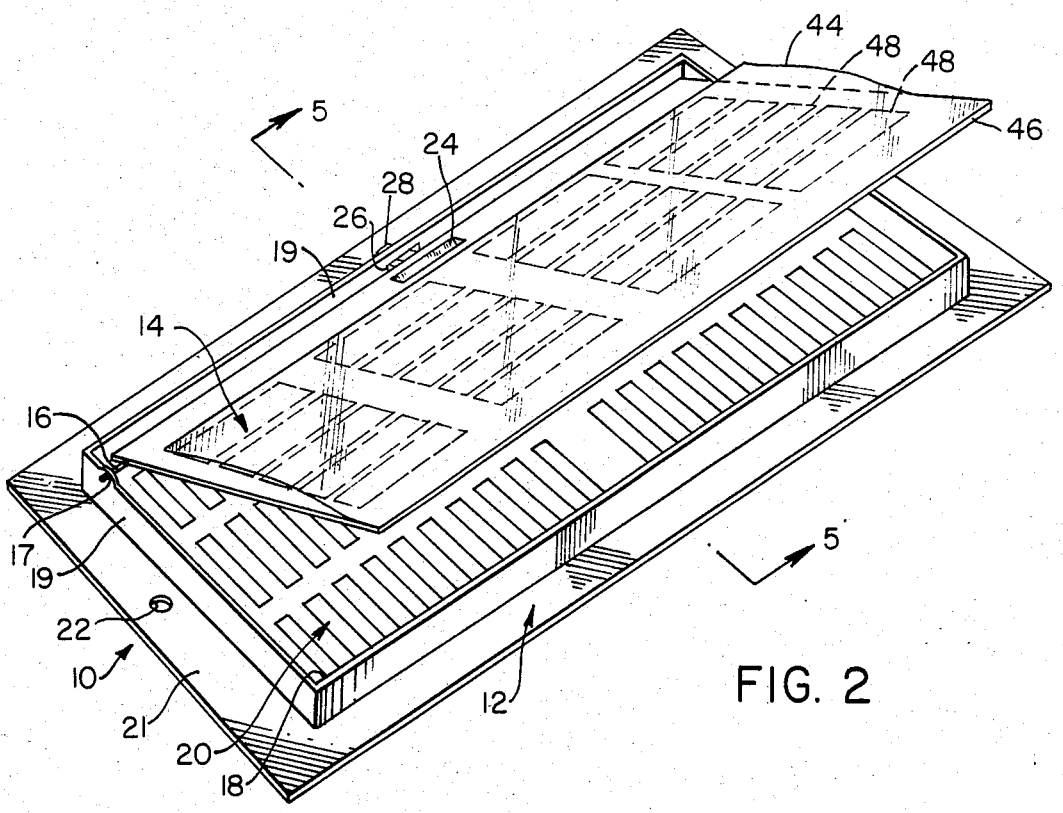
FIG. 2 is a top view in perspective of a unidirectional vent, incorporating the principles of the present invention.
Figure 3:
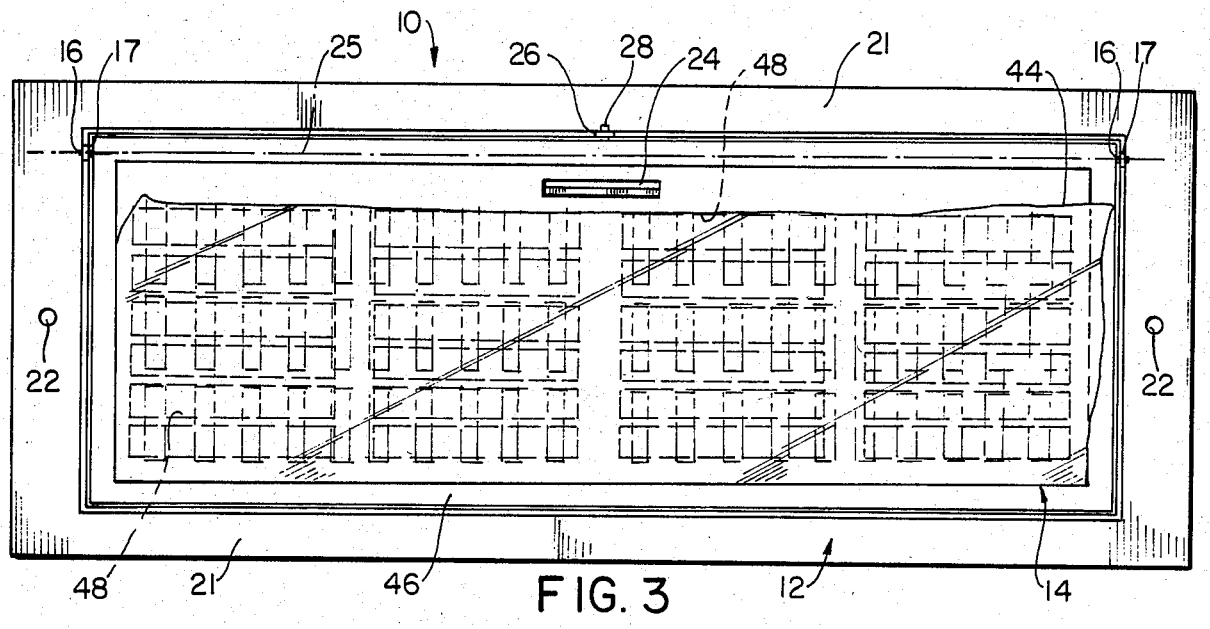
FIG. 3 is a top plan view of the vent of FIG. 2.
Figure 4:
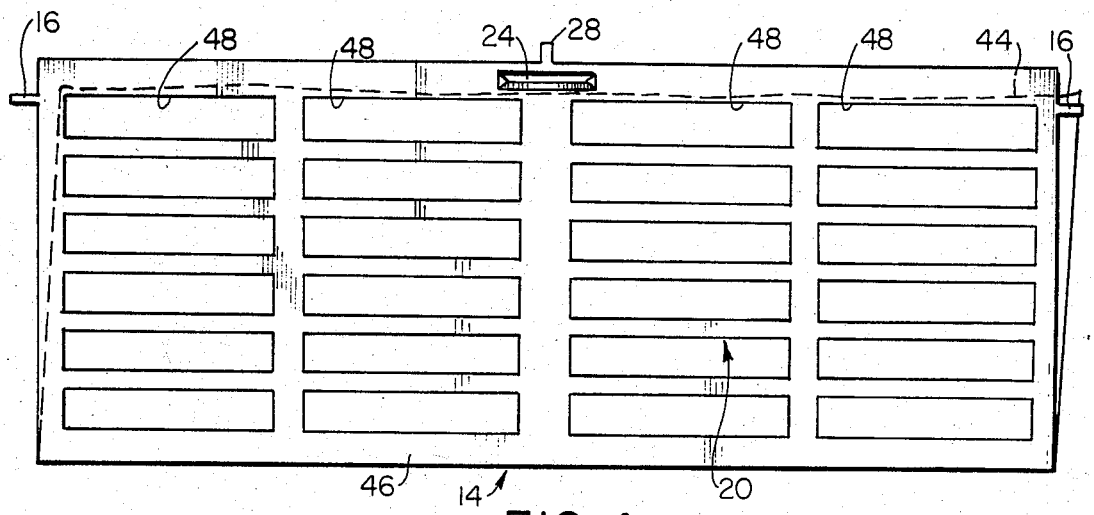
FIG. 4 is a slightly enlarged bottom plan view of the flap shown in FIG. 3.

Referring now to FIGS. 2 through 4, the vent 10 is seen to include a frame 12 and a flap 14. The flap 14 is pivotally affixed to the frame 12 by a pair of protrusions 16 that are integrally formed with the flap 14 and which journal in apertures 17 provided on a lip portion 19 provided on the frame 12, in a conventional manner. The frame 12 has a central passageway 18 disposed therethrough, which may be selectively blocked by the flap 14 depending upon its position relative to the frame 12 as it pivots on the protrusions 16. The frame 12 has the central passageway 18 thereof covered by a grille 20 which preferably is an integral part thereof, as shown in FIG. 4, and is similar to that of conventional vents or registers. Of course, although the grille 20 is shown as having a particular pattern and configuration, it is to be understood that those of ordinary skill in the art can modify this configuration as desired.

In order to reduce the costs of manufacture, the frame 12 and flap 14 are preferably constructed of a plastic material well-suited for such an application. The pivot protrusions 16 provided on the flap 14, may take the form of integrally-formed protrusions which are molded with the flap 14 as shown or may be formed by a rod that extends longitudinally through the flap 14. The edges 21 of the flap 14 include a plurality of mounting apertures 22 for securing the frame 12 to a supporting surface such as ceiling C of FIG. 1. When mounted, the grille 20, as shown in FIG. 2 on the underside of the vent 10 is exposed. The unexposed surface of the vent 10 is shown in FIG. 3 with the flap 14 in a closed position.

The flap 14 has a centrally disposed longitudinal depression 24 disposed therein proximate the pivot axis 25 (broken line) whose function will be described hereinafter. Proximate the wedge-shaped depression 24 is an elongated aperture 26 which extends through the lip portion 19 of frame 12. The aperture 26 is dimensioned to accommodate therethrough and cooperate with a protrusion 28 provided on the flap 14.

Figure 5:
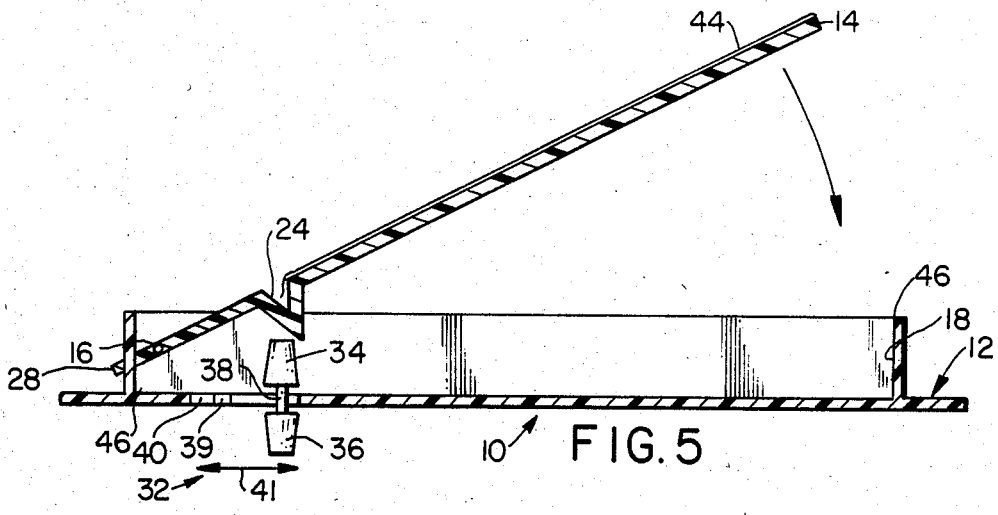
FIG. 5 is a cross-sectional view taken substantially along the lines 5—5 of FIG. 2.

With specific reference to FIG. 5, the manner in which the wedge-shaped depression 24 extends can readily be viewed with the flap 14 being illustrated in an open position. The flap 14 is preferably molded with the substantially V-shaped ridge (wedge-shaped depression) 24 together with the protrusions 16 and 28. The ridge (depression) 24 is adapted to cooperate with an adjustment slide 32. The adjustment slide 32 comprises an inner button 34 and an outer button 36 joined by a shaft 38. The shaft 38 is freely slidably in a slot 40 disposed in the grille 20 of the frame 12 as shown in FIG. 5. The surface of the grille 20, adjacent to the button 34 about the aperture 40, is preferably roughened so as to induce friction between the button 34 and the grille 20 to preclude sliding of the button without user intervention. The substantially V-shaped ridge 24 acts as an incline against which the button 34 interacts and depending upon the placement of the shaft 38 within the slot 40, the degree that the flap is permitted to close can be varied. As illustrated in FIG. 5, when the adjustment slide 32 is at the right hand side of the slot 40, the flap 20 is kept in an open position. As the adjustment slide 32 is moved in the slot 40 toward the left side of the drawing, the amount the flap is kept open decreases until the incline of the substantially V-shaped ridge 30 is no longer contacted and the flap 14 can entirely close the central passageway 18 of the frame 12.

The interaction of the adjustment slide 32 and the substantially V-shaped ridge 30 provides an inexpensive yet effective means of adjusting the degree to which the flap 14 will close. Slot 40 may also be provided with lateral openings to form detents 39 for shaft 38 thereby providing fixed incremental openings for the flap 14. Of course, other suitable means for adjusting the degree of closure of the flap 14 can be employed within the spirit and scope of the invention. Depending upon the particular plastic used to mold the flap 14, flexure thereof may occur where the substantially V-shaped ridge 30 is forced, against the adjustment slide 32. To preclude this, the protrusion 28, as illustrated in FIGS. 2 through 5 has been provided.

The flap 14 may be moved from its rest position, caused by gravity, to an open position as illustrated in FIG. 5 through the action of the adjustment slide 32 when moved in the direction of arrow 41 and its cooperation with the wedge (depression) 24 provided on flap 14.

A membrane 44, preferably fabricated from a material such as Mylar, of about 5 mils in thickness, is affixed to a longitudinal edge 46 of flap 14 in a conventional manner, e.g. glue, double sided adhesive, etc. and is made to extend to essentially cover all of the apertures 48 provided in the flap 14. The membrane 14 being of such a thin, lightweight and strong material is responsive to relatively small flows of rising air currents. Thus, when flap 14 is placed in a closed position the membrane 44 will prevent or preclude any cold air (relatively heavy) from falling through the vent 10 into the room R, via the ceiling, but will permit lighter rising air currents to exit into the attic A, via the openings in flap 14, although in a closed position, since the membrane 44 is sufficiently light and will float upwardly permitting the rising air currents to flow through the flap apertures 48. In a like manner, should the outside atmosphere suddenly drop in pressure, such as that which occurs during a tornado or hurricane, the closed vent 10 would automatically open by the fact that the membrane 44 will rise to accommodate the change in pressure (air moving from the higher pressure of the room to the lower pressure in the atmosphere) and thereby equalize the outside atmosphere and attic pressures, and the pressure in the room R. Similarly, if the vent 10 should have the flap 14 placed in a partially open position permitting some air flow, the air flow may be substantially increased automatically by the membrane 44 rising (opening apertures 48 in flap 14) with a sudden dropping of atmospheric pressure, or small rising air currents occurring in the room R, which may include odoriferous effluents and/or smoke.

Although the vent 10 has been disclosed as being formed from plastic, it is to be understood that it could be made from other materials including metal or the like and may be installed in vertical walls, as well as, ceilings. In addition, configurations other than the rectangular configuration illustrated can be manufactured and square, oval, or round vents are also possible.

Hereinbefore has been disclosed an inexpensive, reliable, unidirectional vent capable of increasing the air flow therethrough with sudden decreases in outside pressure and responding to and exhausting minimal rising air currents.

Although illustrative embodiments of the invention have been described in detail herein with reference to the accompanying drawings, it is to be understood that the invention is not limited to those precise embodiments, and that various changes and modifications may be effected therein without departing from the principles, scope or spirit of the invention.

Having thus set forth the nature of the invention, what is claimed is:

1. An energy saving unidirectional vent for permitting the passage of air from one defined space to another comprising:

(a) frame means for mounting over an opening communicating between said one defined space to said another defined space having a passageway disposed therethrough;

(b) perforated flap means movably mounted to said frame means, said flap means being movable from a closed position substantially blocking said passageway to an open position permitting the free flow of air therethrough, said flap means assuming said closed position when at rest;

(c) membrane means affixed along one edge of said flap means for preventing the flow of air from said another defined space to said one defined space when said flap means is in said closed position and permitting increased air flow from said one defined space to said another defined space under certain conditions; and (d) adjustment means coupled between said flap means and frame means for adjusting the amount of opening of said flap means.

2. The apparatus as defined in claim 1, wherein;

said flap means:

(i) is pivotally affixed to said frame means about an axis, and (ii) includes a wedge means disposed proximate said axis; and said frame means includes:

(i) a slideable member adapted to cooperate with said wedge means to provide the adjustment of said amount of opening.

3. The apparatus as defined in claim 2, wherein said frame means further comprises grille means disposed across said central passageway.

4. The apparatus as defined in claim 3, further comprising means for precluding the bending of said flap means when interacting with said wedge means.

5. The apparatus as defined in claim 1, when said perforated flap means comprises a grille having a plurality of through openings, said membrane means being disposed to generally cover said plurality of openings.

6. The apparatus as defined in claim 1, wherein said membrane means is affixed to said flap means along the edge opposite from said adjustment means.

7. The apparatus as defined in claim 1, wherein said membrane means is affixed to said flap means along one edge thereof and on the surface of said flap means facing said another defined space.

8. The apparatus as defined in claim 1 further including detent means for said adjustment means to provide specific amounts of said opening.

9. The apparatus as defined in claim 1, wherein the flap means further includes means for preventing flexture of said flap.

10. The apparatus as defined in claim 9, wherein said means to prevent flexture includes a protrusion on said flap means adapted to cooperate with an aperture provided on said frame means.

11. An energy saving unidirectional vent for permitting the passage of air from one defined space to another comprising:

(a) frame means for mounting over an opening communicating between said one defined space to said another defined space having a passageway disposed therethrough;

(b) perforated flap means movably mounted to said frame means, said flap means being movable from a closed position substantially blocking said passageway to an open position permitting the free flow of air therethrough, said flap means assuming said closed position when at rest;

(c) membrane means affixed along one edge of said flap means for preventing the flow of air from said another defined space to said one defined space when said flap means is in said closed position and permitting increased air flow from said one defined space to said another defined space under certain conditions, said membrane means being a relatively light weight, flexible material capable of responding to lightly moving air currents; and (d) adjustment means coupled between said flap means and frame means for adjusting the amount of opening of said flap means.

12. The apparatus as defined in claim 11, wherein said membrane means is made from Mylar.

13. The apparatus as defined in claim 12, wherein said membrane means is between 1 and 15 mils (0.0254 and 0.381 mm) thick.

14. The apparatus as defined in claim 13, wherein said membrane means is 5 mils (0.127 mm) thick.

* * * * *